US005274754A

United States Patent [19]

Sfarti

[11] Patent Number: 5,274,754

[45] Date of Patent: Dec. 28, 1993

[54] METHOD AND APPARATUS FOR GENERATING ANTI-ALIASED VECTORS, ARCS AND CIRCLES ON A VIDEO DISPLAY

[75] Inventor: Adrian Sfarti, Sunnyvale, Calif.

[73] Assignee: Advanced Micro Devices, Inc., Sunnyvale, Calif.

[21] Appl. No.: 852,477

[22] Filed: Apr. 14, 1986

[51] Int. Cl.[5] ..... G06P 15/62

[52] U.S. Cl. ..... 395/142

[58] Field of Search ..... 364/518, 521, 522; 340/700, 703, 722, 723; 395/142, 143, 132, 130

[56] References Cited

U.S. PATENT DOCUMENTS

| | | | |
|---|---|---|---|
| 4,262,290 | 4/1981 | Vallins | 340/747 X |
| 4,586,037 | 4/1986 | Rosener et al. | 340/728 |
| 4,593,372 | 6/1986 | Bandai et al. | 364/521 X |
| 4,601,002 | 7/1986 | Rosenthal | 364/518 |
| 4,698,768 | 10/1987 | Thuy et al. | 364/521 |

FOREIGN PATENT DOCUMENTS 2123658 2/1984 United Kingdom .

OTHER PUBLICATIONS

*Filtering Edges for Gray-Scale Displays,* S. Gupta, R. F. Sproull, Computer Graphics, vol. 15, No. 3, Aug. 1981, pp. 1-5.

Fundamentals of Interactive Computer Graphics, J. D. Foley and A. VanDam, Addison-Wesley 1982; pp. 433-435.

*Primary Examiner*—H. A. Herndon

*Attorney, Agent, or Firm*—Fliesler, Dubb, Meyer & Lovejoy

[57] ABSTRACT

A method and apparatus for anti-aliasing vectors, arcs and circles comprising a plurality of pixels on a video display. The distance, d, of each pixel from the centerline of a curve is computed using a plurality of linearly dependent equations. The intensity of each pixel is set as a function of the magnitude of the distance, d, of the pixel from the centerline of the curve. In some cases, the distance, d, is compared with ranges of distances and the intensity of the pixel set according to the range within which the pixel is located. In other cases, the intensity of the pixel is simply inversely proportional to its distance, d, from the centerline.

14 Claims, 3 Drawing Sheets

METHOD AND APPARATUS FOR GENERATING ANTI-ALIASED VECTORS, ARCS AND CIRCLES ON A VIDEO DISPLAY

BACKGROUND OF THE INVENTION

1. Field of the Invention

The present invention relates to a graphics processor for producing vector, arcuate and circular line drawings on a video display in general and in particular to a method and apparatus for anti-aliasing vector, arcuate and circular line drawings on a video display.

2. Description of Prior Art

A video display comprises a plurality of rows and columns of uniformly spaced discrete locations called pixels. The pixels are illuminated by means of one or more electron beams which are directed through holes in a mask which define the boundaries of the pixels.

To draw a vector, i.e. straight line, on the display, the end points $X_1,Y_1$ and $X_2,Y_2$ of the line are sent to a graphics processor. The processor, using a suitable algorithm, such as the Bresenham Line Algorithm described in Fundamentals of Interactive Computer Graphics by Foley & VanDam, identifies the location of all pixels intersected by the vector. If the desired vector passes between the centers of a pair of pixels and, therefore, does not intersect the center of either of them, the algorithm identifies the location of the pixel closest to the centerline of the vector and generates a signal which is used for illuminating that pixel to a predetermined intensity. The selected pixel may be either above or below the centerline of the vector.

The number of pixels in which the center of the pixel is intersected by a vector on a display varies as the slope of the vector on the display changes such that to an observer, as the slope of the vector varies, the vector on the display appears more or less jagged. This effect, which is called aliasing, is analogous to the effect of sampling a signal at a frequency too low to allow exact reconstruction of that particular signal.

Heretofore, a number of proposals have been made to reduce the jagged appearance, i.e. aliasing, of a vector on a video display by selectively controlling the intensity of the illuminated pixels. Typically, the intensity is made inversely proportional to the distance of a pixel from the centerline. In one such proposal, a method called pixel dithering is employed.

In pixel dithering, the intensity of a pixel is controlled by controlling the amount of the electron beam flux which is permitted to impinge on the surface of the display. Recalling that pixel boundaries are defined by the boundaries of a hole in a mask, 100% pixel intensity is achieved when the electron beam is directed into the center of the hole. If the electron beam is turned on during a scan such that 50% of the beam is blocked by the mask, then the pixel intensity will be reduced to 50%. Similarly, if 75% of the beam is blocked by the mask, then the pixel intensity will be reduced to 25%, etc.

The disadvantages of pixel dithering is that it has only been used for anti-aliasing vectors and has not been used for anti-aliasing arcs and circles; it is expensive to build the electronic circuits required for controlling the electron beam, and the vectors displayed on the video display cannot be stored in a bit map.

In another method, to reduce the jagged appearance, i.e. aliasing, of a vector on a video display, it has been proposed to illuminate not one, but two, pixels in either a row or a column of pixels intersected by a vector with the intensity of the pixels being inversely proportional to their distance from the centerline of the vector. For example, in their article *Filtering Edges for Gray-Scale Displays,* Computer Graphics, August 1981, pp.1-5, Gupta and Sproull propose that to improve gray-scale displays, a pair of pixels $T_i$ and $S_i$ be turned on to an intensity inversely proportional to their distances $d_1$ and $d_2$ from the centerline of a vector. The distances $d_1$ and $d_2$ are calculated from the equations:

$$d_1 = t \cos \alpha \quad (1)$$

$$d_2 = s \cos \alpha \quad (2)$$

where:

$d_1$ and $d_2$ are the distances of $T_i$ and $S_i$ from the vector in a direction perpendicular to the vector;

t and s are the vertical distances of $T_i$ and $S_i$ from the centerline of the vector as determined by the Bresenham algorithm; and $\alpha$ = angle of vector relative to a row of pixels intersected by the vector.

After the distances $d_1$ and $d_2$ are calculated, the intensity of the pixels $T_i$ and $S_i$ is made inversely proportional thereto.

Disadvantages of the Gupta and Sproull proposal are that the calculations required for evaluating the expressions (1) and (2) above are generally difficult and time consuming in that they involve independent expressions comprising trigonometric functions. Moreover, they result in producing a "barber-pole" effect, i.e. the intensity of the pixels lying along the centerline of the curve varies, producing an impression of twist.

SUMMARY OF THE INVENTION

In view of the foregoing, principal objects of the present invention are a novel method and apparatus for anti-aliasing vectors, arcs and circles produced on a video display.

In accordance with the above objects, a plurality of linearly dependent equations, which are used in the Bresenham algorithm, are rewritten and thereafter used for generating a plurality of linearly dependent signals. Each of the signals corresponds to one of a plurality of pixels and to the distance of that pixel from the centerline of a curve and is used for illuminating that pixel with an intensity which is a function of the magnitude of said distance. The curve may comprise a vector, an arc, a circle or any combination thereof.

In a number of embodiments of the present invention which are used for anti-aliasing a vector, the distance of a pixel from the centerline of the vector is compared with each one of a plurality of ranges of distances from said vector for generating a signal corresponding to each of the ranges within which the pixel is located according to the following general equation:

$$d_{min} \leqq d \leqq d_{max} \quad (3)$$

where d = distance of pixel from centerline $d_{min}$, $d_{max}$ = numbers of the form N/16 with N = 0,1,2 . . . ,15 and correspond to the minimum and maximum distances of each range from the centerline.

For example, if the distance of a pixel from the centerline of a vector is within a first range of distances from said centerline, the pixel is illuminated with a first predetermined intensity. But if the distance of the pixel from said centerline is within a second range of distances from said centerline, the pixel is illuminated with a second predetermined intensity. Alternatively, if the first and second ranges of distances partially overlap and said distance of said pixel from said centerline is within said overlapping portion of said range of distances, said pixel is illuminated with said first predetermined intensity. But if said distances of said pixel from said centerline is within said non-overlapping range of distances, then said pixel is illuminated with said second predetermined intensity.

In one of the above-described embodiments used for anti-aliasing a vector, called the short-comparator method, equation (3) has the form $$N_{min} \leqq \frac{dx \pm D}{dx/8} \leqq N_{max} \tag{4}$$

where $dx = \max[abs(x_2 - X_l), abs(Y_2 - Y_1)]$ and D is an internal error factor used in the Bresenham algorithm for decision taking In another of the above-described embodiments which is used for anti-aliasing a vector, called the long-comparator method, which provides a greater precision than equation (5) and avoids the division of $dx \pm D$ by $dx/8$ for every pixel but requires a larger arithmetic logic unit for its dynamic range, equation (3) has the form $$\frac{N_{min}dx}{16} \leqq \frac{dx \pm D}{2} \leqq \frac{N_{max}dx}{16} \tag{5}$$

In still another of the above-described embodiments which is used for anti-aliasing a vector, which provides a greater precision than equation (5) but requires an additional bit of dynamic range, equation (3) has the form $$\frac{N_{min}dx}{8} \leqq dx \pm D \leqq \frac{N_{max}dx}{8} \tag{6}$$

In still another embodiment of the present invention which is used for anti-aliasing a vector, each pixel is illuminated with an intensity which is inversely proportional to its distance from the centerline of the vector as determined by the equation $$\frac{dx \pm D}{2dx} \tag{7}$$

In each of a number of further embodiments of the present invention, which is used for anti-aliasing an arc or a circle, the distance of each pixel from the centerline of the arc or circle is compared with each one of a plurality of ranges of distances for generating a signal corresponding to each of the ranges within which the pixel is located as described above for anti-aliasing vectors.

In a first of these embodiments, called the short-comparator method, for the pixels inside and outside the centerline of the arc, equation (3) has the forms $$N_{min} \leqq \frac{2R - abs(D)}{R/8} \leqq N_{max} \tag{8a}$$

and

-continued $$N_{min} \leqq \frac{abs(D)}{R/8} \leqq N_{max} \tag{8b}$$

where

R = radius of arc or circle abs(D) has the range $\epsilon[0,2R]$ respectively.

In another of the embodiments which is used for anti-aliasing an arc or a circle, called the long-comparator method, for the pixels inside and outside the centerline of the arc, equation (3) has the forms $$\frac{N_{min}R}{8} \leqq 2R - abs(D) \leqq \frac{N_{max}R}{8} \tag{9a}$$

and $$\frac{N_{min}R}{8} \leqq abs(D) \leqq \frac{N_{max}R}{8} \tag{9b}$$

In solving equations (9a) and (9b), no division is actually required and only the most significant bit of $N_{min}R$ and $N_{max}R$ is used in the comparators.

In still another embodiment of the present invention which is used for anti-aliasing an arc or a circle, each pixel is illuminated with an intensity which is inversely proportional to its distance from the centerline of the arc or the circle as determined by the expressions $$I_s = \frac{2R - abs(D)}{R/8} \tag{10}$$

$$I_t = \frac{abs(D)}{R/8} \tag{11}$$

In each of the embodiments, because linearly dependent equations instead of independent equations, are used for computing the distance of a pixel from the centerline of a vector, arc or circle, the time and apparatus required for making the computations and setting the intensity of each pixel is significantly reduced from that required in prior known methods and apparatus.

BRIEF DESCRIPTION OF THE DRAWING

The above and other objects, features and advantages of the present invention will become apparent from the following detailed description of the accompanying drawings in which.

DETAILED DESCRIPTION OF THE DRAWING

Figure 1:
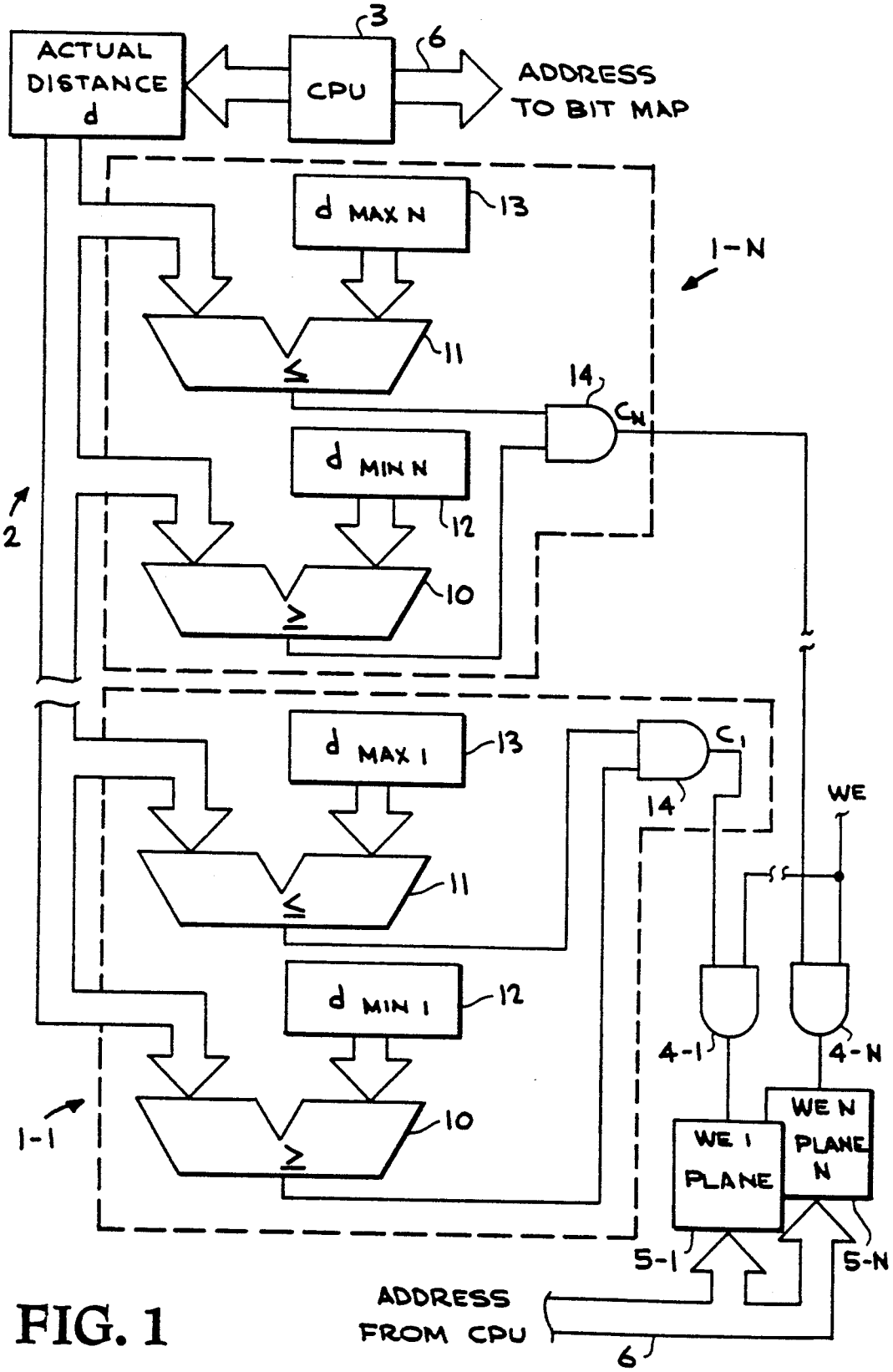
FIG. 1 is a block diagram of a generalized multiple comparator circuit according to the present invention.

Referring to FIG. 1, there is provided in accordance with the present invention a plurality of N comparator circuits 1-1 to 1-N, an actual distance signal bus 2 with means for coupling the bus 2 to a central processing unit (CPU) 3, a plurality of AND gates 4-1 to 4-N, a bit map comprising a plurality of memory planes 5-1 to 5-N and an address bus 6.

In each of the comparator circuit 1-1 to 1-N there is provided a first comparator 10, a second comparator 11, a first reference source 12, a second reference source 13 and an AND gate 14. A first input of the comparators 10 and 11 is coupled to the actual distance signal bus 2. A second input of the comparator 10 is coupled to the reference source 12. The second input of the comparator 11 is coupled to the reference source 13. The outputs of the comparators 10 and 11 are coupled to first and second inputs of the AND gate 14. The output of the AND gate 14 is coupled to a first input of one of the AND gates 4-1 to 4-N. A second input of AND gates 4-1 to 4-N is coupled to a source of write enable pulses WE. The outputs of each of the AND gates 4-1 to 4-N is coupled to the write enable input WE of one of the memory planes 5-1 to 5-N. The address lines of the memory planes 5-1 to 5-N are coupled to the address bus 6.

Figure 2:
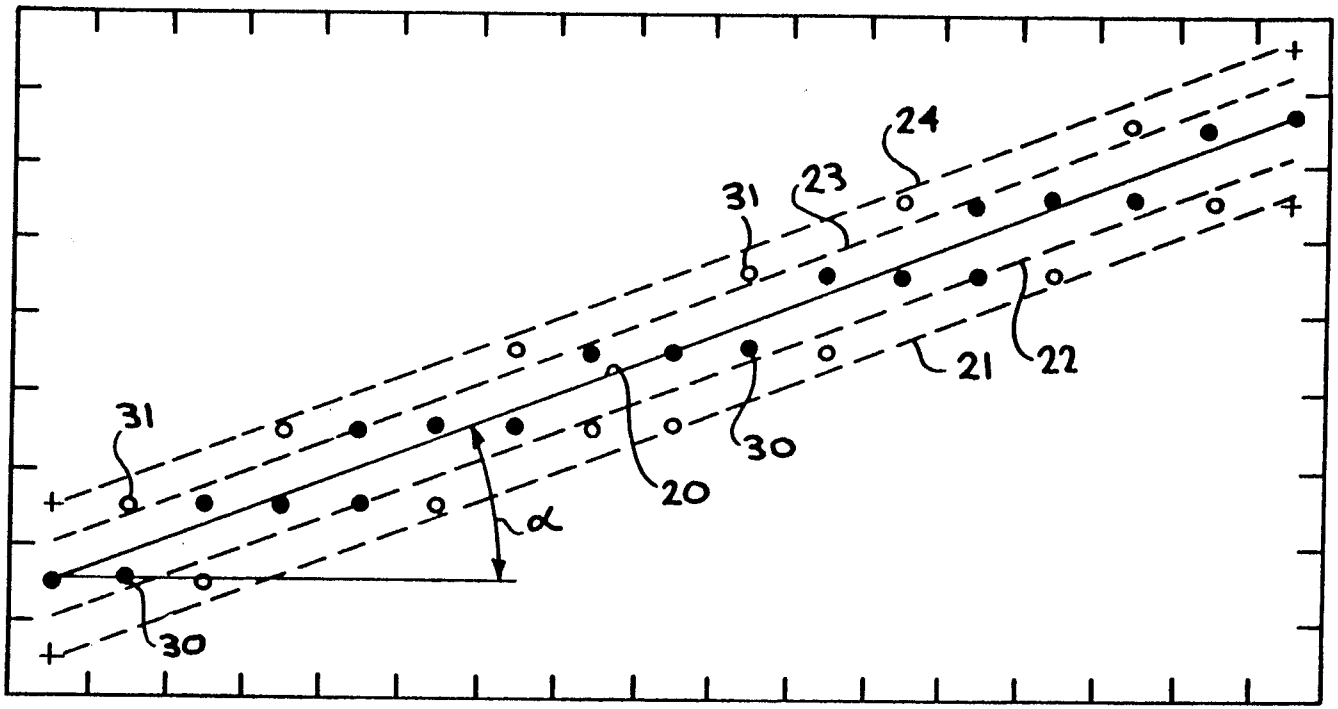
FIG. 2 is a representation of pixels on a video display on which a vector is superimposed.

Referring to FIG. 2, there is shown a plurality of pixels represented by a plurality of squares, with the center of each square representing the center of each pixel. Superimposed upon the pixels and extending at an angle $\alpha$ relative to a row thereof there is shown a vector, the centerline of which is designated 20. On each side of the centerline 20 there is provided a plurality of broken lines 21, 22, 23 and 24. Lines 21–24 represent ranges of distances from the centerline 20 where each range of distance is defined by the quantities $d_{min}$ and $d_{max}$. For example, in FIG. 2, two ranges of distances are represented by the lines 21–24. The first range is from the centerline 20 to the line 22 and from the centerline 20 to the line 23. The second range is from the line 22 to the line 21 and from the line 23 to the line 24. In this example, for the first range the centerline 20 would be represented by $d_{min}$ and the lines 22 and 23 would be represented by $d_{max}$. Similarly, in the second range the lines 22 and 23 would be represented by $d_{min}$ and the lines 21 and 24 would be represented by $d_{max}$.

Also shown in FIG. 2 there is provided a plurality of pairs of filled and unfilled circular marks 30 and 31 which are located at the center of certain ones of the pixels represented by the squares. Each such pair of pixels is associated with a particular position on the centerline 20. This position is defined by a line which extends through both pixels in each pair. As will be further described below, the distance of one of the pixels from the centerline along said line is defined by the quantity, s, in the Bresenham algorithm. The distance of the other pixel from said centerline along said line is defined by the quantity, t, in the Bresenham algorithm. The filled circular marks 30 represent pixels which have been illuminated to a 100% intensity. The unfilled marks 31 represent pixels which have been illuminated to a lesser intensity, e.g. 60% of the intensity of the pixels represented by the filled marks 30. It will be noted that all of the pixels illuminated to 100% intensity fall within the distance range defined by the lines 20–23 and that all of the pixels illuminated to an intensity of 60% fall within the distance range defined by the lines 21 and 22 and 23 and 24.

By varying the intensity of the pixels in proportion to their distance from the centerline 20, it will be appreciated that the apparent jaggedness of the vector represented by the centerline 20, which would appear if only one pixel in each of the above-described pairs of pixels was illuminated, is reduced. This smoothing out of the appearance of the vector is called anti-aliasing.

Referring again to FIG. 1, in operation, the CPU 3, for each pixel, provides a number which correspnds to a distance, d, of that pixel from the centerline 20. The CPU 3 also provides, for each range of distances above and below the centerline 20, a pair of numbers $d_{min}$ and $d_{max}$. The numbers $d_{min}$ and $d_{max}$ define the minimum and maximum distances from the centerline 20 in each range. The boundaries $d_{min}$ and $d_{max}$ of each range are then placed in the registers 12 and 13 and applied to the second input of the comparators 10 and 11. The first input of the comparators 10 and 11 receive the number corresponding to the actual distance, d. In the comparators 10 and 11, the actual distance, d, is compared with each of the range boundaries. If the distance, d, is greater than or equal to the minimum range distance, $d_{min}$, comparator 10 outputs a signal to the first input of the AND gate 14. If the distance, d, is less than or equal to the maximum range distance $d_{max}$, comparator 11 outputs a signal to the second input of the AND gate 14. If both inputs of the AND gate 14 are active, the AND gate 14 outputs a signal C. The signal C indicates that a condition has been met and enables a corresponding one of the AND gates 4-1 to 4-N. The AND gate 4-1 to 4-N which is enabled then provides a write enable pulse WE on its output and applies the pulse WE to a corresponding one of the memory planes 5-1 to 5-N.

At the same time that the CPU 3 generates the boundaries of the distance ranges and the actual distance, d, of a pixel from the centerline of a vector, the CPU 3 also produces an address of the pixel in each of the memory planes 5-1 to 5-N which is applied to the memory planes 5-1 to 5-N by means of the address bus 6. With the address of the pixel applied to all of the memory planes, a bit will be stored at that address only in the memory plane to which the write enable pulse is applied.

In one embodiment of the present invention, each of the memory planes are assigned a predetermined intensity level. During a video refresh, if a pixel location in a memory plane has been set by a signal C as described above, that memory plane will produce a pixel having the predetermined intensity assigned to it.

In another embodiment of the present invention, the intensity of each pixel is determined by a number of memory planes which have been set by a signal C in response to a given write enable pulse. For example, if the minimum boundary for both of the distance ranges represented in FIG. 2 comprise the centerline 20 and the maximum boundaries represented by lines 22 and 21 are used as the references in two of the pairs of comparator circuits 1-1 to 1-N, it will be appreciated that for pixels within the distance range defined by the boundaries 20–22 and 23, two C signals would be produced while only one condition signal C would be produced for those pixels lying within the boundaries defined by the lines 21,22 and 23,24. Thus it can be seen that very fine graduations of intensity can be obtained by using the multiple pairs of comparators having overlapping reference distance ranges.

Figure 3:
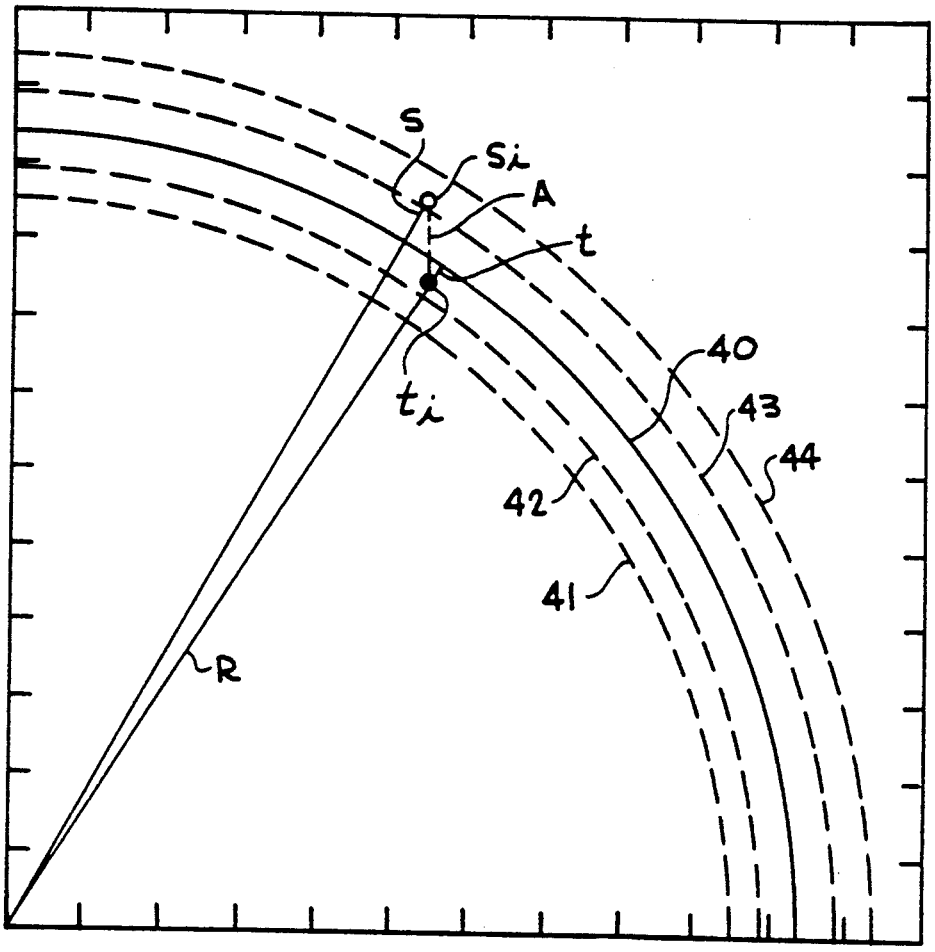
FIG. 3 is a representation of pixels on a video display on which an arc is superimposed.

Referring to FIG. 3, there is shown a segment of a circle, or arc having a centerline designated as 40, a plurality of distance ranges represented by a plurality of lines 41, 42, 43 and 44 inside and outside the centerline 40 and a plurality of pairs of filled and unfilled circular marks defining the centers of pixels, S and T, located on radial lines outside and inside of the centerline, respectively. The lines 40–44 define the minimum and maximum of distance ranges, $d_{min}$ and $d_{max}$.

In operation, the CPU 3 produces a number corresponding to the radial distance, d, of each pixel from the centerline and the numbers $d_{min}$ and $d_{max}$. These numbers are compared and condition signals $C_1$–$C_N$ are produced for controlling the intensity of pixels as described above with respect to the vectors of FIG. 2.

In additional embodiments of the present invention as will be further described below, the distance, d, of each pixel from the centerline of a vector, arc or circle is used directly to control the intensity of the pixel such that the intensity of the pixel is inversely proportional to the distance, d.

From the foregoing description of the operation of the apparatus of FIG. 1 wherein the intensity of a pixel is determined by means of a comparative analysis and the alternative embodiments of the present invention wherein the intensity of a pixel is inversely porportional to its distance, d, from the centerline of a curve, it will be appreciated that the calculation of the actual distance, d, from the centerline of a straight or arcuate curve should be done with the greatest precision consistent with a minimum of computation and apparatus.

To avoid the difficult and time consuming operations of computing the distance, d, from the centerline of a curve for each pixel from independent expressions comprising trigonometric functions, such as used by Gupta and Sproull, supra, modifications of equations used in the Bresenham Line Algorithm are provided. As will be seen from the following discussion, the distance, d, for each pixel is computed from a plurality of linearly dependent equations for use in both the vector as well as arc interpolation methods and apparatus described above.

1. Vector interpolation

As is well known, the Bresenham algorithm calculates for every pair of pixels closest to the centerline of a curve their distances to the centerline. These distances are s and t where:

$$s+t=1 \tag{12}$$

$$(s-t)\cdot dx=D \tag{13}$$

$s,t \in [0,1]$ $dx=\max[\mathrm{abs}(x_2-x_1), \mathrm{abs}(y_2-y_1)]$ and

D is an internal error factor used in the algorithm for decision taking.

Rewriting expressions (12) and (13), the following expressions are obtained:

$$s=\tfrac{1}{2}(1+D/dx) \tag{14}$$

$$t=\tfrac{1}{2}(1-D/dx) \tag{15}$$

Because $s,t \in [0,1]$ and $s+t=1$, it follows that D has the same order of magnitude as dx, i.e.

$$D=(s-t)dx=(1-2t)dx \tag{16}$$

It follows from (15) and (16) that $$\mathrm{abs}D=dx\cdot\mathrm{abs}(1-2t)\leqq dx \tag{17}$$

As described above with respect to the apparatus of FIG. 1, a pixel gets intensified to a predetermined intensity if the distance, d, from the centerline is in a predetermined range as defined by the following general equation:

$$d_{min}\leqq d\leqq d_{max} \tag{18}$$

where $d_{min}$, $d_{max}$ are numbers of the form N/16 with N=0,1,2 . . . , 15 Equation (18) can then be rewritten as:

$$N_{min}\leqq 16d\leqq N_{max} \tag{19}$$

Replacing d with either s or t, we get:

$$N_{min}\leqq 16\times\tfrac{1}{2}(1\pm D/dx)\leqq N_{max} \tag{20}$$

which is equivalent to:

$$N_{min}\leqq 8(1\pm D/dx)\leqq N_{max} \tag{21}$$

From equation (21), the general equation (18) can be rewritten in three different forms for use in the above-described apparatus as follows:

1.1 The short-comparator method $$N_{min}\leqq\frac{dx\pm D}{dx/8}\leqq N_{max} \tag{22}$$

where $N_{min}$, $N_{max}$=0,1, . . . ,15 For each pixel the value $dx\pm D$ is calculated and divided by the precalculated constant dx/8. The result is then compared using two four bit comparators, e.g. comparators 10 and 11 of FIG. 1, against $N_{min}$ and $N_{max}$.

The short-comparator method has the advantage that only 4-bit comparators are required and the disadvantages that the integer division dx/8 reduces the precision of the comparison and that a division $dx\pm D/ct$, where ct=a constant, must be executed for every pixel.

1.2 The long-comparator method

Rewriting equation (22), to eliminate the expression dx/8, the following equation is obtained:

$$\frac{N_{min}dx}{16}\leqq\frac{dx\pm D}{2}\leqq\frac{N_{max}dx}{16} \tag{23}$$

where $(dx\pm D)/2$ has the range of $2dx/2=dx$.

The advantages of the long-comparator method are that the values $(N\times dx)/16$ are precalculated once at initialization by a 4-bit right shift with the only loss of precision being the 4 least significant bits in the right shifting of $N_{min}\times dx/16$ and $N_{max}\times dx/16$ and 1 least significant bit in the right shifting of $dx\pm D/2$. The disadvantage of the long-comparator method is that more bits are required in an ALU to maintain the necessary dynamic range than is required to compute d in the short-comparator method.

The long-comparator method can be also used as an improvement of the short-comparator method by using five bit comparators instead of four bit comparators as shown by the following example:

Suppose that dx=10, D=2, $N_{min}=3$ and $N_{max}=1$. By applying the short-comparator method, one obtains:

$$\frac{dx+D}{dx/8}=\frac{10+2}{10/8}=\frac{12}{1}=12_{(10)}=1100_{(2)} \tag{24}$$

where $10_{(10)}=1010_{(2)}$ shifted three bits to the right produces 0001 and $N_{min}=0011_{(2)}$, $N_{max}=1101_{(2)}$. Since $0011_{(2)}<1100_{(2)}1101_{(2)}$, it follows that the pixel is inside the bounds. By applying the long-comparator method using 5-bit comparators, one obtains:

$$\frac{dx+D}{2}=\frac{12}{2}=6=0110.0_{(2)} \tag{25}$$

-continued $$\frac{N_{min}dx}{16} = \frac{3 \times 10}{16} = \frac{11110_{(2)}}{16} = 0001.1_{(2)} \quad (26)$$

$$\frac{N_{max}dx}{16} = \frac{13 \times 10}{16} = \frac{130}{16} = \frac{100000\ 10_{(2)}}{16} \quad (27)$$

where $30_{(10)}=11110_{(2)}$ shifted 4 bits to the right produces 0001.1 and $130_{(10)}=10000010_{(2)}$ shifted 4 bits to the right produces $1000.0_{(2)}$; and $$0001.1_{(2)}<0110.0_{(2)}<1000.0_{(2)}$$

Obviously the long-comparator method using 5-bit comparators is more precise since the short-comparator method makes a rather poor approximation, replacing $$\frac{10+2}{10/8} = 9.6 \text{ by } 12.$$

The long-comparator method, on the other hand, approximates $$\frac{3 \times 10}{16} = 1.875_{(10)} \text{ by } 0001.1_{(2)} = 1.5_{(10)}$$

and $$\frac{13 \times 10}{16} = 8.125_{(10)} \text{ by } 1000.0_{(2)} = 8_{(10)}$$

From the foregoing discussion it is seen that the long-comparator method is faster, relative to the short-comparator method, in that it requires only two multiplications in the setup; and more precise, in that it employs a minimum amount of division and affects only the three least significant bits of $N \times dx$ and only 1 least significant bit of $dx \pm D$. Still, it should be noted that if n planes, i.e. n pairs of comparators, are used there are theoretically n possible intensity combinations. However, using two comparators per pixel, only $n+1$ of the possible intensity combinations can be ordered in a decreasing fashion.

1.3 The inverse distance method

The inverse distance method simply calculates the values $$\frac{dx \pm D}{2 \cdot dx}$$

for each pair of pixels with four bits of precision. By interpreting the four bits as the encoding of 16 levels of intensity in four bit planes, the intensity I is equal to:

$$I_s=16(1-s) \quad (28)$$

$$I_t=16(1-t) \quad (29)$$

or from equations (14) and (15)

$$I = 16\left\{1 - \frac{dx \pm D}{2 \cdot dx}\right\} = \frac{16}{2 \cdot dx}(dx \pm D) = \frac{dx \pm D}{dx/8} \quad (30)$$

The inverse distance method has the advantage of producing 16 possible levels of intensity. It has the disadvantages that: it requires division for each pixel; it is imprecise due to the integer division dx/8; and it requires the use of a color look-up table to compensate for the fact that it produces a variable intensity along the centerline, which in turn produces an unpleasant twisting effect. Moreover, increasing the number of bit planes from 4 to 8 doesn't add any extra information—there are still only 16 levels of intensity that can be produced; and the correction necessary for creating consistent intensity vectors may not be the same with the standard gamma correction implemented in the color look-up table.

2. Arc (circle) interpolation

Referring again to FIG. 3, for any given point $S_i=(X_i,Y_i)$ residing outside the circumference of an arc at a radial distance s, one can write:

$$x_i^2+y_i^2=(R+s)^2 => x_i+y_i^2-R^2=(R+s)^2-R^2=S(2R+s), \quad (31)$$

where R=radius of the arc. Since $s<<2R$ and $X_i^2+Y_i^2-R^2=D$ (the internal error of the Bresenham algorithm), one can write:

$$D \approx s \cdot 2R => S \approx D/2R \quad D \geqq 0 \quad (32)$$

The point $T_i$, which is the other candidate for antialiasing, is situated at a distance t inside the circle. With A comprising the intersection of the line $S_iT_i$ with the circumference of the circle, then:

$$\frac{s}{t} = \frac{S_iA}{T_iA} = \frac{s+t}{t} = \frac{S_iA + T_iA}{T_iA} = \frac{1}{T_iA} \quad (33)$$

but $T_iA \approx t => s+t/t \approx 1/t => s+t \approx 1 => t \approx 1-s$. Hence $$t=1-D/2R \quad (34)$$

for $D \geqq 0$ and $D=abs(D) => t \approx 1-abs(D)/2R$

In reality, the point $(X_i,Y_i)$ as interpolated by the Bresenham algorithm oscillates between being inside and outside the ideal circumference, i.e.

$$X_i^2+Y_i^2-R^2 \lesseqgtr 0 => D \lesseqgtr 0. \quad (35)$$

This problem is solved by making $$s = \frac{abs(D)}{2 \cdot R} \quad (36)$$

and $$t = 1 - \frac{abs(D)}{2R} \quad (37)$$

As in the case of vector interpolation discussed above, it is not necessary to identify which is the main pixel and which is the antialiasing candidate. All that is required is to compare s and t with the reference values $d_{min}$ and $d_{max}$ when comparators are used or to calculate the intensities $I_s=16(1-s)$, $I_t=16(1-t)$ if the inverse distance method is used, as follows:

$$N_{min} \leqq 16d \leqq N_{max} \quad (38)$$

$$N_{min} \leqq 16 \times \frac{abs(D)}{2R} \leqq N_{max} \quad (39)$$

$$N_{min} \leqq 16\left\{1 - \frac{abs(D)}{2R}\right\} \leqq N_{max} \quad (40)$$

2.1 The short-comparator method $$N_{min} \leqq \frac{abs(D)}{R/8} \leqq N_{max} \quad (41)$$

$$N_{min} \leqq \frac{2R - abs(D)}{R/8} \leqq N_{max} \quad (42)$$

abs(D) $\epsilon$[0,2R]

2.2 The long-comparator method $$\frac{N_{min} \times R}{8} \leqq abs(D) \leqq \frac{N_{max} \times R}{8} \quad (43)$$

$$\frac{N_{min} \times R}{8} \leqq 2R - abs(D) \leqq \frac{N_{max} \times R}{8} \quad (44)$$

2.3. The inverse distance method $$I_s = 16(1 - s) = 16\left\{1 - \frac{abs(D)}{2R}\right\} = \frac{2R - abs(D)}{R/8} \quad (45)$$

$$I_t = 16(1 - t) = 16\left\{1 - 1 + \frac{abs(D)}{2R}\right\} = \frac{abs(D)}{R/8} \quad (46)$$

From the foregoing discussion, it is apparent that the long-comparator method may be preferred for anti-aliasing arcs because no division is actually required. In practice, only the most significant bit of $N_{min} \times R$ and $N_{max} \times R$ is retained and the three least significant bits are simply ignored.

While several embodiments of the present invention are described above, various modifications may be made thereto without departing from the spirit and scope of the present invention. For example, the illustrated embodiments comprising comparator circuits are described with respect to two ranges of distances. However, it is contemplated that any number N of distance ranges may be used with a comparable number of comparators. For this reason, it is intended that the scope of the invention not be limited to the embodiments illustrated but be determined by reference to the claims hereinafter provided.

What is claimed is:

1. In a graphics processor having a plurality of pairs of first and second comparators, each of said comparators having a first and a second input and an output, a plurality of first and second AND gate means, each of said first and second AND gate means having an output, a plurality of memory planes and a video display, said video display having a plurality of pixels, a method for anti-aliasing a curve having a centerline on said video display comprising the steps of:

generating for each one of a plurality of predetermined positions on said centerline a plurality of signals which correspond to the distance each of a predetermined number of said pixels is from said position;

generating a predetermined number of pairs of first and second numbers, said first number in each of said pairs having a magnitude corresponding to a predetermined minimum distance from said centerline and said second number in each of said pairs having a magnitude corresponding to a predetermined maximum distance from said centerline, each of said pairs of numbers defining a predetermined range of distances from said centerline;

applying a number corresponding to said distance each of said predetermined number of pixels is from said position on said centerline to said first input of each of said first and second comparators;

applying one of said first numbers corresponding to said minimum distance in each of said ranges of distances from said centerline to said second input of one of said first comparators, respectively, each of said first comparators providing a signal on its output when the magnitude of said number applied to its first input is equal to or greater than the magnitude of the number applied to its second input;

applying one of said second numbers corresponding to said maximum distance in each of said ranges of distances from said centerline to said second input of one of said second comparators, respectively, each of said second comparators providing a signal on its output when the magnitude of said number applied to its first input is equal to or less than the magnitude of the number applied to its second input;

coupling said outputs of said first and second comparators in each pair of comparators to a different one of said first AND gate means, each of said first AND gate means providing a signal on its output when there is a signal generated on the output of both said first and second comparators coupled thereto;

coupling a write enable signal to a first input of each of said second AND gate means;

coupling said output of each of said first AND gate means to a second input of a different one of said second AND gate means;

coupling said output of each of said second AND gate means to a different one of said plurality of memory planes, respectively; and addressing said memory planes for storing a bit in each memory plane in response to an output from the second AND gate means coupled thereto, said bit and the memory plane in which it is stored determining the intensity of the pixel associated therewith.

2. A method according to claim 1 wherein said distance of each of said pixels from said centerline comprises a distance, d, said minimum distance comprises a distance $d_{min}$ said maximum distance comprises a distance $d_{max}$ and said steps of applying said numbers to said first and second inputs of said comparators comprises the step of comparing said d with said $d_{min}$ and said $d_{max}$ according to the equation:

$$d_{min} \leqq d \leqq d_{max}.$$

3. A method according to claim 2 wherein:

$$d = \frac{dx \pm D}{dx/K}$$

$d_{min} = N_{min}$
$d_{max} = N_{max}$
$dx = \max[abs(X_2 - X_1), abs(Y_2 - Y_1)]$
D = internal error factor in Bresenham algorithm
$X_1, X_2, Y_1, Y_2$ = define the end points of a curve
K = constant
$N_{min}, N_{max}$ = an integer.

4. A method according to claim 2 wherein:

$$d = \frac{dx \pm D}{K}$$

$$d_{min} = \frac{N_{min}dx}{M}$$

$$d_{max} = \frac{N_{max}dx}{M}$$

$dx = \max[abs(X_2 - X_1), abs(Y_2 - Y_1)]$
D = internal error factor in Bresenham algorithm
$X_1, X_2, Y_1, Y_2$ = define the end points of a curve
K,M = constant
$N_{min}, N_{max}$ = an integer.

5. A method according to claim 2 wherein:

$$d = \frac{2R - abs(D)}{R/K} \text{ or } d = \frac{abs(D)}{R/K}$$

$d_{min} = N_{min}$
$d_{max} = N_{max}$
R = radius of an arc
D = internal error factor in Bresenham algorithm
abs(D) $\epsilon$[0,2R]
K = constant
$N_{min}, N_{max}$ = an integer.

6. A method according to claim 2 wherein:

$$d = 2R - abs(D) \text{ or } d = abs(D)$$

$$d_{min} = \frac{N_{min}R}{K}$$

$$d_{max} = \frac{N_{max}R}{K}$$

R = radius of an arc
D = internal error factor in Bresenham algorithm
abs(D) $\epsilon$[0,2R]
K = constant
$N_{min}, N_{max}$ = an integer.

7. A method of anti-aliasing an arc having a centerline on a video display, said video display having a plurality of pixels comprising the steps of:

generating for each one of a plurality of predetermined positions on said centerline a plurality of signals which correspond to the distance each of a predetermined number of said pixels is from said position inside and outside of said arc; and illuminating on said display in response to said signals each of said predetermined number of said pixels outside said arc with an intensity $I_s$ and each of said predetermined number of said pixels inside said arc with an intensity $I_t$ according to the equations:

$$I_s = \frac{2R - abs(D)}{R/K}$$

$$I_t = \frac{abs(D)}{R/8}$$

where
R = radius of an arc
D = internal error factor in Bresenham algorithm
abs(D) ( [0,2R]
K = constant.

8. An apparatus for anti-aliasing an arc having a centerline on a video display, said video display having a plurality of pixels comprising, means for generating for each one of a plurality of predetermined positions on said centerline a plurality of signals which correspond to the distance each of a predetermined number of said pixels is from said position inside and outside of said arc; and means for illuminating on said display in response to said signals each of said predetermined number of pixels outside said arc with an intensity $I_s$ and each of said predetermined number of pixels inside said arc with an intensity $I_t$ according to the equations:

$$I_s = \frac{2R - abs(D)}{R/K}$$

$$I_t = \frac{abs(D)}{R/8}$$

where
R = radius of an arc
D = internal error factor in Bresenham algorithm
abs(D) ( [0,2R]
K = constant.

9. An apparatus for anti-aliasing a curve having a centerline on a video display, said video display having a plurality of pixels comprising:

a plurality of pairs of first and second comparators, each of said comparators having a first and a second input and an output;

means for generating for each one of a plurality of predetermined positions on said centerline a plurality of signals which correspond to the distance each of a predetermined number of said pixels is from said position;

means for generating a predetermined number of pairs of first and second numbers, said first number in each of said pairs having a magnitude corresponding to a predetermined minimum distance from said centerline and said second number in each of said pairs having a magnitude corresponding to a predetermined maximum distance from said centerline, each of said pairs of numbers defining a predetermined range of distances from said centerline;

means for applying a number corresponding to said distance each of said predetermined number of pixels is from said position on said centerline to said first input of each of said first and second comparators;

means for applying one of said first numbers corresponding to said minimum distance in each of said ranges of distances from said centerline to said second input of one of said first comparators, respectively, each of said first comparators providing a signal on its output when the magnitude of said number applied to its first input is equal to or greater than the magnitude of the number applied to its second input;

means for applying one of said second numbers corresponding to said maximum distance in each of said ranges of distances from said centerline to said second input of one of said second comparators, respectively, each of said second comparators providing a signal on its output when the magnitude of said number applied to its first input is equal to or less than the magnitude of the number applied to its second input;

a plurality of first AND gates, each of said first AND gates having an output;

means for coupling said outputs of said first and second comparators in each pair of comparators to a different one of said first AND gates, each of said first AND gates providing a signal on its output when there is a signal generated on the output of both said first and second comparators coupled thereto;

a plurality of second AND gates, each of said second AND gates having an output;

means for coupling a write enable signal to a first input of each of said second AND gates;

means for coupling said output of each of said first AND gates to a second input of a different one of said second AND gates;

a plurality of memory planes;

means for coupling said output of each of said second AND gates to a different one of said plurality of memory planes, respectively; and means for addressing said memory planes for storing a bit in each memory plane in response to an output from the second AND gate coupled thereto, said bit and the memory plane in which it is stored determining the intensity of the pixel associated therewith.

10. An apparatus according to claim 9 wherein said distance of each of said pixels from said centerline comprises a distance, d, said minimum distance comprises a distance $d_{min}$ and said maximum distance comprises a distance $d_{max}$ and said first and second comparators comprise means for comparing said d with said $d_{min}$ and said $d_{max}$ according to the equation:

$$d_{min} \leqq d \leqq d_{max}.$$

11. An apparatus according to claim 10 wherein:

$$d = \frac{dx \pm D}{dx/K}$$

$d_{min} = N_{min}$
$d_{max} = N_{max}$
$dx = \max[\mathrm{abs}(X_2 - X_l), \mathrm{abs}(Y_2 - Y_1)]$
D = internal error factor in Bresenham algorithm
$X_l, X_2, Y_1, Y_2$ = define the end points of a curve
K = constant
$N_{min}, N_{max}$ = an integer.

12. An apparatus according to claim 10 wherein:

$$d = \frac{dx \pm D}{K}$$

$$d_{min} = \frac{N_{min} dx}{M}$$

$$d_{max} = \frac{N_{max} dx}{M}$$

$dx = \max[\mathrm{abs}(X_2 - X_l), \mathrm{abs}(Y_2 - Y_1)]$
D = internal error factor in Bresenham algorithm
$X_l, X_2, Y_1, Y_2$ = define the end points of a curve
K,M = constant
$N_{min}, N_{max}$ = an integer.

13. An apparatus according to claim 10 wherein:

$$d = \frac{2R - abs(D)}{R/K} \text{ or } d = \frac{abs(D)}{R/K}$$

$d_{min} = N_{min}$
$d_{max} = N_{max}$
R = radius of an arc
D = internal error factor in Bresenham algorithm
$\mathrm{abs}(D) \in [0, 2R]$
K = constant
$N_{min}, N_{max}$ = an integer.

14. An apparatus according to claim 10 wherein:

$$d = 2R - abs(D) \text{ or } d = abs(D)$$

$$d_{min} = \frac{N_{min} R}{K}$$

$$d_{max} = \frac{N_{max} R}{K}$$

R = radius of an arc
D = internal error factor in Bresenham algorithm
$\mathrm{abs}(D) \in [0, 2R]$
K = constant
$N_{min}, N_{max}$ = an integer.

* * * * *